US005467714A

United States Patent [19]

Lund et al.

[11] Patent Number: 5,467,714

[45] Date of Patent: Nov. 21, 1995

[54] ENHANCED PERFORMANCE, HIGH REACTION TEMPERATURE EXPLOSIVE

[75] Inventors: Gary K. Lund, Ogden; Paul C. Braithwaite, Brigham City, both of Utah

[73] Assignee: Thiokol Corporation, Ogden, Utah

[21] Appl. No.: 168,714

[22] Filed: Dec. 16, 1993

[51] Int. Cl.[6] ..... C06B 45/12

[52] U.S. Cl. ..... 102/284; 102/288; 102/289; 149/15; 149/14

[58] Field of Search ..... 102/284, 288, 102/289; 149/14, 15

[56] References Cited

U.S. PATENT DOCUMENTS

| | | | |
|---|---|---|---|
| 694,295 | 2/1902 | Maxim | 149/15 X |
| 2,977,885 | 4/1961 | Perry, Jr. et al. | 102/98 |
| 3,067,686 | 12/1962 | Coover, Jr. et al. | 102/98 |
| 3,163,113 | 12/1964 | Davis et al. | 102/284 X |
| 3,496,870 | 2/1970 | Fulmer | 102/103 |
| 3,554,181 | 1/1971 | Gawlick et al. | 44/3 X |
| 3,763,787 | 10/1973 | Schultz | 60/255 X |
| 3,995,559 | 12/1976 | Bice et al. | 102/100 |
| 4,098,625 | 7/1978 | French et al. | 149/19.3 |
| 4,406,228 | 9/1983 | Boettcher et al. | 149/15 X |

*Primary Examiner*—Peter A. Nelson

*Attorney, Agent, or Firm*—Ronald L. Lyons; Madson & Metcalf

[57] ABSTRACT

High reaction temperature explosive compositions which provide enhanced air blast and extended reaction times are disclosed. The explosive compositions include a separate acceptor phase and a separate explosive phase. The acceptor phase contains a halogenated polymer and a reactive metal which are capable of reacting at high temperature and pressure. The explosive phase includes a nonmetallized explosive. Suitable explosives produce a detonation pressure in excess of 200 kilobars at the Chapman-Jouget (C-J) condition.

In the explosive compositions disclosed herein, at least a portion of the explosive phase surrounds the acceptor phase. In this configuration, detonation of the explosive phase exposes the acceptor phase to high temperatures and pressures which permit the metal and halogenated polymer to efficiently react and produce even greater temperatures and pressures.

30 Claims, 2 Drawing Sheets

ENHANCED PERFORMANCE, HIGH REACTION TEMPERATURE EXPLOSIVE

BACKGROUND OF THE INVENTION

1. Field of the Invention

This invention relates to high reaction temperature explosive compositions designed for use in applications which require enhanced air blast or extended reaction time.

2. Technology Background

Metallized explosives having a halogenated polymer binder are known. In theory, there is a high amount of energy available from the metal-halogen reaction. It is this reaction which releases large quantities of heat and provides a more sustained pulse than that generated by the initial explosive reaction. However, initiation of the metal-halogen reaction is difficult. Conventional metallized explosives suffer from poor metal combustion and subsequent delivered performance.

Although most high temperature explosives utilize a metal-oxygen reaction, metal-halogen reaction may be preferred in some cases because halogenated polymers have a higher density than typical C—N—H—O polymers. Higher density generally translates into higher performance characteristics, such as pressure, detonation velocity, and temperature.

Typical high reaction temperature explosives include PBXN-103 (40% AP, 27% Al, 23% trimethylolethane trinitrate, 6% nitrocellulose (plastisol grade), 2.5 triethyleneglycol dinitrate, 1.3 ethyl centralite, and 0.2% resorcinol), Aluminized COMP A-4 (64% COMP A-4 (97% RDX and 3% wax), 35% Al powder, and 1% graphite and/or calcium stearate), and TRITONAL (80/20) (80% TNT and 20% Al). These explosives are usually prepared by melt/cast, mix/cast, solvent loss, or pressed processing techniques. Initiation of the metal-halogen reaction is difficult because of the high activation energy.

A common disadvantage of known high reaction temperature explosive compositions is poor combustion efficiency caused by diluting the explosive with metal and/or binder.

From the foregoing, it will be appreciated that there remains a need in the art for enhanced performance explosive compositions which produce high reaction temperature.

Such explosive compositions are disclosed and claimed herein.

SUMMARY OF THE INVENTION

The present invention is directed to high reaction temperature explosive compositions which provide enhanced air blast and extended reaction times. The explosive compositions of the present invention include a separate acceptor phase and a separate explosive phase. The acceptor phase contains a halogenated polymer phase and a reactive metal phase. In some cases, the halogenated polymer phase and the reactive metal phase may be mixed.

The halogenated polymer phase includes a halogenated polymer which may be partially or fully halogenated. The halogenated polymer phase may also include plasticizers, stabilizers, curatives, cross-linkers, and cure catalysts commonly used in the art. Suitable halogenated polymers will exothermically react with certain metals to provide the high reaction temperature characteristics of the present invention.

The reactive metal phase includes a reactive metal which has a highly exothermic heat of formation of the metal oxide and metal halide. Typical reactive metals include Al, B, Ca, Li, Mg, Si, Sn, Ti, and Zr. Mixtures of reactive metals and reactive metal alloys, such as aluminum-magnesium alloy, and intermetallic compounds may also be used according to the present invention. In addition to the reactive metals, metal hydrides may optionally be included in the acceptor phase.

The explosive phase includes a nonmetallized explosive. Suitable explosives which may be included in the explosive phase are preferably capable of producing a detonation pressure in excess of 200 kilobars at the Chapman-Jouget (C-J) condition. Typical explosive formulations suitable for use in the present invention include mixtures of a high explosive in a polymeric binder.

Importantly, the acceptor phase is surrounded by at least a portion of the explosive phase. When the explosive phase is detonated, the acceptor phase is exposed to high temperatures and pressures which enable the metal and halogenated polymer to efficiently react and produce even greater temperatures and pressures.

Various explosive charge configurations are possible according to the present invention. Two currently preferred configurations of the present invention include a "jelly roll" configuration and a concentric cylinder configuration. In a typical "jelly roll" configuration, the explosive phase and the acceptor phase are in the form of flexible layers which are tightly rolled together with the explosive phase on the outside. In a concentric cylinder configuration, the acceptor phase and the explosive phase are formed as concentric cylinders with the explosive phase on the outside.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
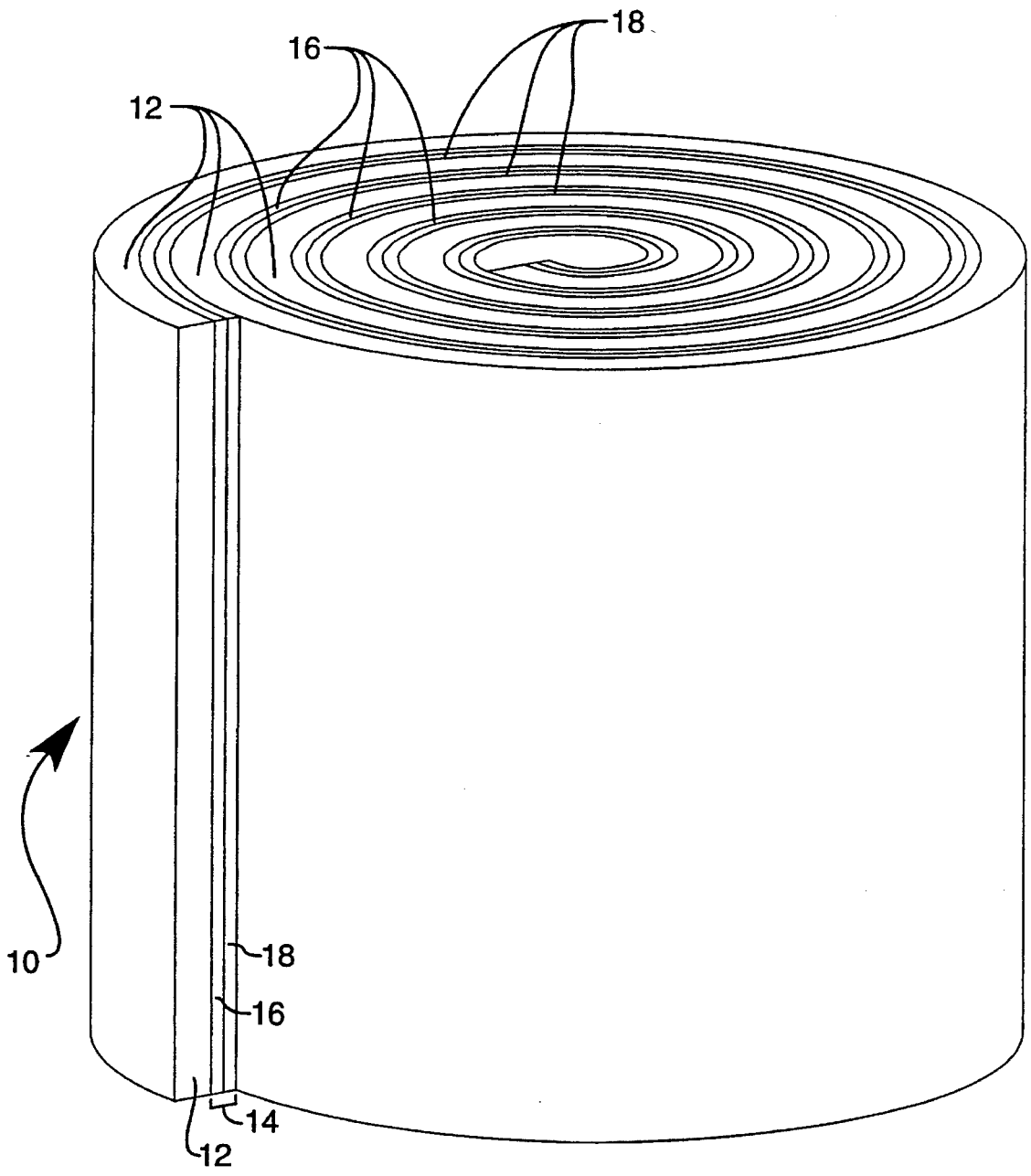
FIG. 1 is a perspective view of a typical "jelly roll" explosive charge configuration in which separate layers of explosive phase, halogenated polymer phase, and reactive metal phase are rolled together, with the explosive phase on the outside.

The present invention is directed to high reaction temperature explosive compositions for use in applications which require enhanced air blast or extended reaction times. Typical applications for such explosive compositions include runway cratering and heaving, destruction of reinforced concrete structures, behind armor effects, and destruction of underwater targets.

The explosive compositions of the present invention include an acceptor phase and an explosive phase which are separate and distinct from each other. The acceptor phase contains a halogenated polymer phase and a reactive metal phase. In some cases, the halogenated polymer phase and the reactive metal phase may be mixed to achieve more intimate contact, to obtain a relatively short reaction time, to simplify manufacture, or to control the reaction. However, in most cases the halogenated polymer phase and the reactive metal phase will be separate and distinct phases to reduce sensitivity and to extend the reaction length.

The halogenated polymer phase includes a halogenated polymer which may be partially or fully halogenated. The halogenated polymer phase may also include plasticizers, stabilizers, curatives, cross-linkers, and cure catalysts commonly used in the art. Suitable halogenated polymers will exothermically react with certain metals to provide the enhanced performance characteristics of the present invention. Nonhalogenated polymers have generally lower densities which prevent them from matching the performance achieved according to the present invention. Typical halogenated polymers include Teflon® (tetrafluoroethylene (TFE)), Viton® A, (a fluorinated ethylene propylene copolymer sold by DuPont), Kel-F® 800 (copolymer of chlorotrifluoroethylene and vinylidene fluoride sold by 3M), and L-9939 (a perfluoropolyether diol sold by 3M). Other halogenated polymers which may be used include polyvinylidene fluoride, polydifluorochloroethylene, fluorinated polyethers, PVC (polyvinyl chloride), perfluoroacrylates, and mixtures thereof.

The reactive metal phase includes a reactive metal which has a high heat of formation of the metal oxide and metal halide. Typical reactive metals include Al, B, Ca, Li, Mg, Si, Zn, Ti, and Zr. Mixtures of reactive metals and reactive metal alloys, such as aluminum-magnesium alloy, and intermetallic compounds, such as $Al_3Mg_2$, $Al_{38}Si_5$, $Al_2Zr_3$, $B_{12}Zr$, $MgB_4$, TiAl, and $TiB_2$, may also be used according to the present invention. In addition to the reactive metals, metal hydrides may optionally be included in the acceptor phase. Examples of typical metal hydrides include $NaBH_4$, $LiAlH_4$, $TiH_2$, LiH, and $ZrH_2$.

An important feature of the present invention is that the acceptor phase is encapsulated by at least a portion of the explosive phase. It is currently believed that surrounding the acceptor phase with an explosive phase exposes the acceptor phase to high temperatures and pressures upon detonation of the explosive phase. The high temperatures and pressures permit the metal and halogenated polymer of the acceptor phase to efficiently react and produce even greater temperatures and pressures.

Figure 2:
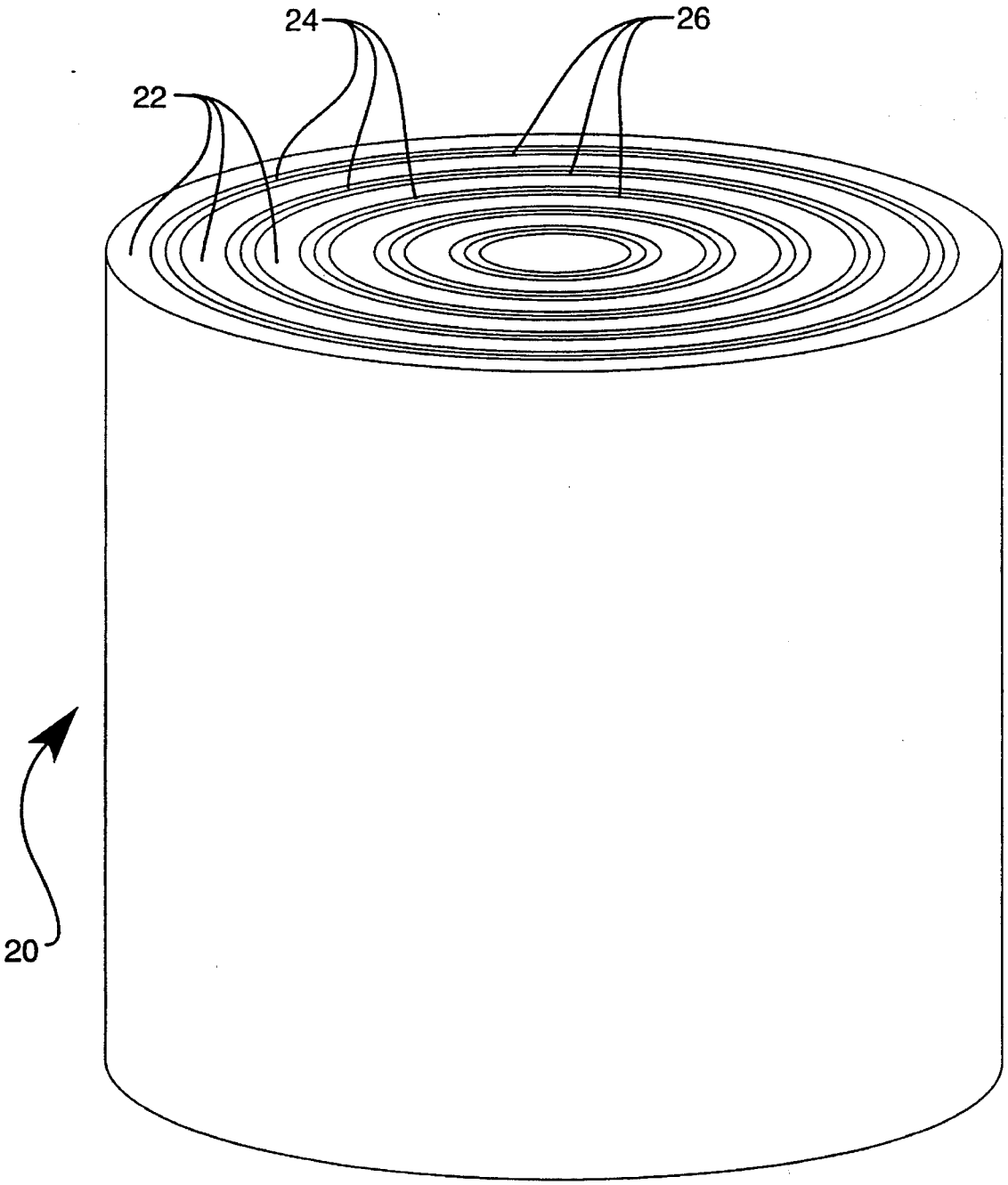
FIG. 2 is a perspective view of a typical concentric cylinder explosive charge configuration in which the explosive phase, halogenated polymer phase and reactive metal phase are prepared as concentric cylinders.

Two currently preferred explosive charge configurations of the present invention include a "jelly roll" configuration and a concentric cylinder configuration. As shown in FIG. 1, an explosive charge 10 in a typical "jelly roll" configuration includes an explosive phase 12 and an acceptor phase 14 in the form of flexible layers which are tightly rolled together with the explosive phase on the outside. The acceptor phase 14 includes a halogenated polymer phase 16 and a reactive metal phase 18. As shown in FIG. 2, an explosive charge 20 in a typical concentric cylinder configuration includes an explosive phase 22, a halogenated polymer phase 24, and a reactive metal phase 26 in the form of concentric cylinders with the explosive phase 22 on the outside of the explosive charge.

Other explosive charge configurations may also be used according to the present invention. For example, the acceptor phase may be in the form of rods or pellets encapsulated by the explosive phase.

The explosive phase is substantially free of metal. Nonmetallized explosives are preferred. As used herein, explosives which are substantially free of metal may contain nominal amounts of metal, up to 5% by weight, whereas metallized explosives usually contain at least 20% metal. Metallized explosives often produce a slower detonation wave since the metal does not detonate. By separating the metal and explosive phase, the two phase reaction process is accentuated causing the effective reaction time to lengthen.

Suitable explosives which may be included in the explosive phase are preferably capable of producing a detonation pressure in excess of 200 kilobars at the Chapman-Jouget (C-J) condition. Typical detonation velocities are in excess of 5000 meters/second. To be used in the present invention, the explosive phase must be sufficiently flexible to be rolled, if used in a "jelly roll" configuration. If a concentric cylinder configuration is used, then the explosive phase must be castable, pressable, extrudable, or moldable into thin walled concentric cylinders.

Typical explosive formulations suitable for use in the present invention include mixtures of a high explosive in an inert or energetic polymeric system such as from 70% to 92% CL-20 (also known as "HNIW", 2,4,6,8,10,12-hexanitro-2,4,6,8,10,12-hexaazatetracyclo[$5.5.0.0^{5,9}0^{3,11}$ ]-dodecane), RDX (1,3,5-trinitro-1,3,5-triaza-cyclohexane), HMX (1,3,5,7-tetranitro-1,3,5,7-tetraaza-cyclooctane), ADN (ammonium dinitramide), TNAZ (1,3,3-trinitroazetidine), and PETN (pentaerythritol tetranitrate) in from 8% to 30% polymeric binder system. Commercially available Detasheet® A, C, LF, or HP sold by DuPont may also be used. Detasheet® A and C are based on PETN, while Detasheet® HP and LF are based on RDX. An explosive based on 88% HMX in a 12% HTPB binder with isocyanate cure may be used in the present invention. Similarly, Composition C-4, an explosive based on 91% RDX in polyisobutylene, may also be used. Other known or novel high explosives which produce the desired detonation pressure may also be used in the present invention.

A significant problem believed to be solved by the present invention is initiation of the metal-halogen reaction. It is this reaction which releases the large quantities of heat which are key to sustaining the pulse generated by the initial explosive reaction. The present invention avoids problems encountered with conventional metallized explosives which suffer from poor metal combustion and subsequent delivered performance.

For instance, in the jelly roll configuration the explosive may be detonated at one or both ends and as the detonation wave moves down the flexible explosive the metal/halogenated polymer layers are exposed to the high temperatures and pressures of the detonation. The high pressures and temperatures are essential to the complete reaction of the metal and halogenated polymer which in turn releases a large amount of heat. By separating the metal, halogenated polymer, and high explosive, relatively insensitive high explosive compositions may be employed since the explosive is not diluted by the metal or halogenated polymer. Thus, the high velocity and detonation pressure of the nonmetallized explosive is used to advantage in enhancing the overall efficiency of the explosive charge.

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLE 1

An explosive charge was prepared by rolling layers of Detasheet® A-4 (a flexible explosive produced by DuPont containing pentaerythritol tetranitrate (PETN)), aluminum foil, and Teflon® tape in a "jelly roll" configuration as described above. A sheet of Detasheet® A-4 was placed at each end of the rolled cylinder. The explosive charge was placed inside a 1-cubic yard concrete block and detonated simultaneously at each end using primer cord to initiate the reaction. Charges were also prepared from equivalent amounts of Detasheet® A-4 and TNT. These control explosive charges were placed inside other concrete blocks and were initiated using an identical method. All concrete blocks were poured at the same time using concrete from the same mix.

In all three cases, the detonation reaction shattered the concrete block and threw fragments considerable distances. The effectiveness of each explosive charge was determined by mapping the distance thrown and weight of each concrete fragment over five pounds in the southwest quadrant of the fragment pattern. The amount of work required to move the concrete from its initial to final position was calculated.

Based on debris, the Detasheet® A-4 produced generally smaller pieces (10–50 pounds) with the least total work impulse. The TNT and Al/Teflon/Detasheet® A-4 were less brisant, producing somewhat larger pieces, particularly the Al/Teflon/Detasheet® A-4 "jelly roll" (20–100 pounds). In general, the "jelly roll" heaved the largest pieces the furthest, while the Detasheet® A-4 alone exhibited the highest brisance and the least work in the quadrant. The total work impulse, based upon fragments greater than 5 pounds, is summarized in Table 1, below.

TABLE 1

| Explosive Charge | Work Impulse |
|---|---|
| Detasheet ® A-4 | 16,760 ft/lb |
| TNT | 19,593 ft/lb |
| Al/Teflon/Detasheet ® A-4 | 28,274 ft/lb |

From the foregoing, the Al/Teflon/Detasheet® A-4 explosive composition of the present invention performed considerably more work on the concrete than either the TNT or the Detasheet® explosive.

Theoretical equilibrium calculations for the three explosive charges at the Chapman-Jouget (C-J) condition are summarized in Table 2, below. The Al/Teflon/Detasheet® A-4 explosive charge ingredients had the following weight percentages: 9.1% Al, 13.7% Teflon, and 77.2% Detasheet® A-4.

TABLE 2

| Explosive Charge | Density (g/cc) | Detonat. Velocity (m/s) | Detonat. Pressure (atm.) | Detonat. Temp. (°K.) |
|---|---|---|---|---|
| Detasheet ® A-4 | 1.48 | 7366 | 209,891 | 2612 |
| TNT | 1.63 | 7348 | 225,224 | 2696 |
| Al/Teflon/ Detasheet ® A-4 | 1.48 | 7027 | 189,093 | 3406 |

These data indicate that the Chapman-Jouget (C-J) detonation temperature of the Al/Teflon/Detasheet® A-4 explosive of the present invention is considerably higher than either of the other two explosives tested. These data further support the conclusion that a slower detonation velocity and lower detonation pressure in an explosive in combination with higher reaction temperature are desirable characteristics for explosives used to break concrete. It is believed that the high temperature is a significant reason that the enhanced explosive was able to transfer more energy to the concrete than either of the other explosives.

EXAMPLE 2

The theoretical performance of several candidate enhanced performance, high reaction temperature explosives according to the present invention are shown in Table 3. Candidate explosives evaluated in this study include candidates in which the reactive metal and halogenated polymer are distinct phases (candidates containing aluminum and Teflon) and candidates in which the reactive metal and halogenated polymer phase are intimately mixed (candidates containing L-9939/aluminum and Kel-F® 800/aluminum). Also shown in Table 3 are the predicted performance for two typical general purpose aluminized explosives, Tritonal and PBXN-109. Theoretical specific impulse, equilibrium temperature, equivalence ratio and density were determined for each candidate explosive using the NASA Lewis SP273 computer program. (NASA Lewis SP273 is a program that calculates thermodynamic and transport properties of complex mixtures.) The density and specific impulse were used to predict the detonation pressure of each composition using the method of Gill, Asaoka and Baroudy, "On Underwater Detonations, I. A New Method For Predicting the CJ Detonation Pressure of Explosives," *Journal of Energetic Materials,* vol. 5, pp. 287–307 (1987).

As shown in Table 3, the predicted detonation pressures for the candidate explosives which use the PGN CL-20 explosive are considerably higher than that predicted for Tritonal or PBXN-109. These explosives all have predicted equilibrium temperatures which are equal to or higher than those calculated for the standard explosive. Furthermore all candidate explosives, shown in Table 3, have significantly lower equivalence ratio's than Tritonal or PBXN-109. A high equivalence ratio (above 3.0) indicates that the explosive is fuel rich and will likely perform poorly due to inefficient combustion. Because of their relatively low equivalence ratio's the candidate explosives are expected to react more completely and more nearly match the predicted performance values. The combination of higher predicted detonation pressures, high temperatures and low equivalence ratio's indicate that the candidate explosives shown below will have superior performance in applications which require enhanced air blast or extended reaction times.

TABLE 3

| Explosive Charge Composition (%) | Detonat. Pressure (Katm.) | Temperature (°K.) @ 1000 psi | Equivalence Ratio |
|---|---|---|---|
| Standard Explosives | | | |
| TRITONAL | 303.6 | 2803 | 3.28 |
| PBXN-109 | 280.6 | 2630 | 3.65 |
| Candidate Explosives | | | |
| Detasheet ® C/Al/ Teflon 60/20/20 | 283.5 | 2439 | 2.69 |
| PGN-CL-20/Al/Teflon | | | |

TABLE 3-continued

| Explosive Charge Composition (%) | Detonat. Pressure (Katm.) | Temperature (°K.) @ 1000 psi | Equivalence Ratio |
|---|---|---|---|
| 60/20/20 | 387.6 | 2847 | 2.26 |
| 70/15/15 | 388.9 | 3205 | 2.08 |
| 70/20/10 | 395.9 | 3223 | 2.21 |
| PGN-CL-20/Al/L-9939 Polymer 70/9/21 | 384.5 | 3704 | 2.09 |
| PGN-CL-20/Al/ Kel-F ® 800 70/20/10 | 387.7 | 3165 | 2.25 |

From the foregoing it will be appreciated that the present invention provides enhanced performance explosive compositions which produce high reaction temperature.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An explosive composition comprising:

an acceptor phase containing a halogenated polymer phase and a reactive metal phase; and an explosive phase which is substantially free of metal, wherein at least a portion of said explosive phase encapsulates the acceptor phase and wherein said explosive phase is capable of producing a detonation pressure in excess of 200 kilobars at the Chapman-Jouget (C-J) condition;

wherein the explosive composition has a detonation velocity in excess of 5000 meters per second.

2. An explosive composition as defined in claim 1, wherein the reactive metal phase is mixed within the halogenated polymer phase to form the acceptor phase.

3. An explosive composition as defined in claim 1, wherein the reactive metal phase is separate and distinct from the halogenated polymer phase.

4. An explosive composition as defined in claim 3, wherein the reactive metal phase and the halogenated polymer phase are configured as layers.

5. An explosive composition as defined in claim 4, wherein the explosive phase, the reactive metal phase, and the halogenated polymer phase are each configured as layers.

6. An explosive composition as defined in claim 4, wherein the explosive phase, the reactive metal phase, and the halogenated polymer phase are each configured as alternating spiral layers.

7. An explosive composition as defined in claim 1, wherein the explosive phase, the reactive metal phase, and the halogenated polymer phase are each configured as concentric cylinders wherein the explosive phase is included in an outer concentric cylinder.

8. An explosive composition as defined in claim 1, wherein the explosive phase and the acceptor phase are configured as layers.

9. An explosive composition as defined in claim 8, wherein the explosive phase and the acceptor phase are each configured as alternating spiral layers.

10. An explosive composition as defined in claim 1, wherein the explosive phase and the acceptor phase are each configured as concentric cylinders wherein the explosive phase is included in an outer concentric cylinder.

11. An explosive composition as defined in claim 1, wherein the explosive phase comprises a high explosive selected from CL-20, HMX, RDX, ADN, TNAZ, and PETN.

12. An explosive composition as defined in claim 11, wherein the explosive phase further comprises a polymeric binder system.

13. An explosive composition as defined in claim 1, wherein the reactive metal phase comprises a reactive metal selected from Al, B, Ca, Li, Mg, Si, Zn, Ti, and Zr.

14. An explosive composition as defined in claim 1, wherein the halogenated polymer phase comprises a partially halogenated polymer.

15. An explosive composition as defined in claim 1, wherein the halogenated polymer phase comprises a fully halogenated polymer.

16. An explosive composition as defined in claim 1, wherein the halogenated polymer phase includes a halogenated polymer selected from tetrafluoroethylene, fluorinated ethylene propylene copolymer, chlorotrifluoroethylene and vinylidene fluoride copolymer, perfluoropolyether diol, polyvinylidene fluoride, polydifluorochloroethylene, fluorinated polyethers, polyvinyl chloride, perfluoroacrylate, and mixtures thereof.

17. An explosive composition as defined in claim 16, wherein the halogenated polymer phase further includes an ingredient selected from plasticizers, stabilizers, curatives, cross-linkers, and cure catalysts.

18. An explosive composition as defined in claim 1, wherein the acceptor phase further comprises a metal hydride.

19. An explosive composition as defined in claim 18, wherein the metal hydride is selected from $NaBH_4$, $LiAlH_4$, $TiH_2$, LiH, and $ZrH_2$.

20. A high reaction temperature explosive composition comprising:

an acceptor phase containing a halogenated polymer phase and a reactive metal phase, said halogenated polymer phase including a halogenated polymer selected from tetrafluoroethylene, fluorinated ethylene propylene copolymer, chlorotrifluoroethylene and vinylidene fluoride copolymer, perfluoropolyether diol, polyvinylidene fluoride, polydifluorochloroethylene, fluorinated polyethers, polyvinyl chloride, perfluoroacrylate, and mixtures thereof, and said reactive metal phase containing a reactive metal selected from Al, B, Ca, Li, Mg, Si, Zn, Ti, and Zr; and an explosive phase which is substantially free of metal, wherein at least a portion of said explosive phase encapsulates the acceptor phase and wherein said explosive phase is capable of producing a detonation pressure in excess of 200 kilobars at the Chapman-Jouget (C-J) condition;

wherein the explosive composition has a detonation velocity in excess of 5000 meters per second.

21. A high reaction temperature explosive composition as defined in claim 20, wherein the explosive phase and the acceptor phase are configured as layers.

22. A high reaction temperature explosive composition as defined in claim 20, wherein the explosive phase and the acceptor phase are each configured as alternating spiral layers.

23. A high reaction temperature explosive composition as defined in claim 20, wherein the explosive phase and the acceptor phase are each configured as concentric cylinders wherein the explosive phase is included in an outer concentric cylinder.

24. A high reaction temperature explosive composition as defined in claim 20, wherein the reactive metal phase is mixed within the halogenated polymer phase to form the acceptor phase.

25. A high reaction temperature explosive composition as defined in claim 20, wherein the reactive metal phase is separate and distinct from the halogenated polymer phase.

26. A high reaction temperature explosive composition as defined in claim 20, wherein the explosive phase comprises a high explosive selected from CL-20, HMX, RDX, ADN, TNAZ, and PETN.

27. A high reaction temperature explosive composition as defined in claim 26, wherein the explosive phase further comprises a polymeric binder system.

28. A high reaction temperature explosive composition as defined in claim 20, wherein the acceptor phase further comprises a metal hydride.

29. A high reaction temperature explosive composition as defined in claim 28, wherein the metal hydride is selected from $NaBH_4$, $LiAlH_4$, $TiH_2$, LiH, and $ZrH_2$.

30. A high reaction temperature explosive composition as defined in claim 20, wherein the halogenated polymer phase further includes an ingredient selected from plasticizers, stabilizers, curatives, cross-linkers, and cure catalysts.

* * * * *